US009958202B2

(12) United States Patent
De Santos Avila et al.

(10) Patent No.: US 9,958,202 B2
(45) Date of Patent: May 1, 2018

(54) INERTED PLATE DRYER AND METHOD OF DRYING SOLVENT BASED COATING

(75) Inventors: Juan De Santos Avila, Temple City, CA (US); Kostas N. Christodoulou, Sierra Madre, CA (US); Ahmad Khodaei, Rancho Cucamonga, CA (US); Ali R. Mehrabi, Glendale, CA (US); Luigi Sartor, Pasadena, CA (US); Henk De Koning, Zevenhuizen (NL); George Arkesteijn, Nootdorp (NL)

(73) Assignee: Avery Dennison Corporation, Glendale, CA (US)

( * ) Notice: Subject to any disclaimer, the term of this patent is extended or adjusted under 35 U.S.C. 154(b) by 356 days.

(21) Appl. No.: 14/237,919

(22) PCT Filed: Aug. 9, 2012

(86) PCT No.: PCT/US2012/050145

§ 371 (c)(1),
(2), (4) Date: Feb. 10, 2014

(87) PCT Pub. No.: WO2013/023058

PCT Pub. Date: Feb. 14, 2013

(65) Prior Publication Data

US 2014/0202028 A1 Jul. 24, 2014

Related U.S. Application Data

(60) Provisional application No. 61/522,547, filed on Aug. 11, 2011.

(51) Int. Cl.
*F26B 3/20* (2006.01)
*F26B 25/00* (2006.01)
(Continued)

(52) U.S. Cl.
CPC ..... *F26B 3/20* (2013.01); *F26B 21/14* (2013.01); *F26B 25/006* (2013.01); *F26B 13/10* (2013.01);
(Continued)

(58) Field of Classification Search
CPC .... F26B 3/283; F26B 3/28; F26B 3/30; F26B 3/305
See application file for complete search history.

(56) References Cited

U.S. PATENT DOCUMENTS 1,506,789 A * 9/1924 Sutherland, Jr. ..... F26B 13/101 34/143
2,573,121 A * 10/1951 Wandelt ..... F26B 3/283 34/635
(Continued)

FOREIGN PATENT DOCUMENTS

GB 140141 3/1920

OTHER PUBLICATIONS

Chilworth Technology, Inc, "Preventing Explosion Hazard—Inert Gas Blanketing", 1994, Solids Handling, May/Jun.*
(Continued)

*Primary Examiner* — Kenneth Rinehart
*Assistant Examiner* — Logan Jones
(74) *Attorney, Agent, or Firm* — Mark E. Bandy; Rankin, Hill & Clark LLP

(57) ABSTRACT

An inerted plate dryer for drying solvent based coating is disclosed. The dryer uses two tiers of substantially parallel heating plates that are located not more than 10 cm apart. A moving web with solvent based coating is passed through the dryer, and runs closer to one of the heating plates. The method of using such inerted plate dryer is also disclosed.

1 Claim, 6 Drawing Sheets

(51) Int. Cl.

| | |
|---|---|
| ***F26B 21/14*** | (2006.01) |
| ***F26B 13/10*** | (2006.01) |
| ***F26B 21/12*** | (2006.01) |
| ***F26B 21/04*** | (2006.01) |

(52) U.S. Cl.
CPC ..... *F26B 21/04* (2013.01); *F26B 21/12* (2013.01); *F26B 25/008* (2013.01)

(56) References Cited

U.S. PATENT DOCUMENTS 3,151,954 A * 10/1964 Ege ..... F26B 13/10 34/229
3,437,321 A * 4/1969 Wilkinson ..... F26B 3/305 34/79
3,584,846 A * 6/1971 McCoy ..... D06C 7/00 34/231
3,628,758 A 12/1971 Nichols
3,924,569 A * 12/1975 Hunter ..... B29D 30/40 118/61
3,931,684 A * 1/1976 Turnbull ..... F26B 5/00 34/242
4,092,784 A * 6/1978 Dietrich ..... B29B 13/065 34/168
4,118,873 A * 10/1978 Rothchild ..... B01J 19/122 219/388
4,143,468 A * 3/1979 Novotny ..... B05D 3/067 250/398
4,146,974 A * 4/1979 Pray ..... F26B 3/283 34/571
4,150,494 A * 4/1979 Rothchild ..... B01D 8/00 134/28
4,223,450 A 9/1980 Rothchild
4,240,453 A * 12/1980 Vial ..... B08B 3/08 134/107
4,268,977 A 5/1981 Geiger
4,321,757 A 3/1982 van der Blom
4,337,582 A * 7/1982 Smith ..... F26B 25/006 34/469
4,378,207 A * 3/1983 Smith ..... B31F 1/285 266/103
4,411,075 A * 10/1983 Blaudszun ..... F26B 21/14 219/388
4,416,618 A * 11/1983 Smith ..... B23K 1/0053 431/328
4,475,293 A 10/1984 Banerjee
4,654,980 A * 4/1987 Bhat ..... F26B 25/006 34/228
4,764,402 A 3/1988 Pagendarrn et al.
4,882,852 A * 11/1989 Kautto ..... D21F 5/002 34/273
4,894,927 A * 1/1990 Ogawa ..... F26B 3/283 34/507
4,926,567 A * 5/1990 Ogawa ..... F26B 21/14 34/449
5,001,845 A 3/1991 Norz et al.
5,054,212 A 10/1991 Isnikawa
5,136,790 A 8/1992 Hagen et al.
5,212,877 A 5/1993 Onur et al.
5,231,772 A 8/1993 Hermanns et al.
5,454,177 A 10/1995 Dutournier
5,581,905 A 12/1996 Hueisman et al.
5,694,701 A 12/1997 Huelsrnan et al.
5,881,476 A 3/1999 Strobush et al.
5,980,697 A 11/1999 Kolb et al.
6,047,151 A 4/2000 Carvalho et al.
6,119,362 A * 9/2000 Sundqvist ..... D21F 5/00 34/120
6,134,808 A 10/2000 Yapel et al.
6,256,904 B1 7/2001 Kolb et al.
6,293,200 B1 9/2001 Straubinger et al.
6,511,708 B1 1/2003 Kolb et al.
6,553,689 B2 4/2003 Jain et al.
6,579,370 B2 6/2003 Kimura et al.
6,682,598 B1 * 1/2004 Steinmueller ..... C04B 35/62218 118/58
6,780,225 B2 8/2004 Shaw et al.
6,808,739 B2 10/2004 Sitz et al.
6,996,921 B2 2/2006 Kolb et al.
7,032,324 B2 4/2006 Kolb et al.
7,100,302 B2 9/2006 Kolb et al.
7,143,528 B2 12/2006 Kolb
2003/0230003 A1 12/2003 Miller et al.
2006/0191160 A1 8/2006 Miller et al.
2008/0060217 A1 3/2008 Swoboda et al.
2008/0115384 A1 5/2008 Krizek et al.
2012/0085281 A1 * 4/2012 Helms, Jr. ..... C30B 31/12 118/641

OTHER PUBLICATIONS

Kutchta, J. M. 1986 Investigation of Fire and Explosion Accidents in the Chemical, Mining and Fuel-Related Industries—A Manual. Bulletin 680. Bureau of Mines, USA.
Moller, W. O., Molnarne, M., Sturm, R. 1998. Limiting Oxygen Concentration: Recent Results and their Presentation in Chemsafe. Presented at 9th International Symposium on Loss Prevention and Safety Promotion in the Process Industries, May 1998, Barcelona, Spain.
Ramesh, N. & Duda, J. L. 2001. Analysis of a Gap Dryer Used to Produce Polymer Films and Coatings. AIChE 47:972-983.
Zabetakis, M. G. 1965 Flammability Characteristics of Combustible Gases and Vapors. Bulletin 627. Bureau of Mines, USA.
Zinn Jr., S. V. 1971. Inerted Fuel Tank Oxygen Concentration Requirements. Report FAA-RD-71-42, National Aviation Facilities Experimental Center, Federal Aviation Administration, Department of Transportation. USA.
Invitation to Pay Additional Fees issued in corresponding International Application No. PCT/US2012/050145 dated Nov. 8, 2012.
International Preliminary Report on Patentability Fees issued in corresponding International Application No. PCT/US2012/050145 dated Feb. 11, 2014.
International Search Report and Written Opinion issued in corresponding International Application No. PCT/US2012/050145 dated Mar. 6, 2013.

* cited by examiner

INERTED PLATE DRYER AND METHOD OF DRYING SOLVENT BASED COATING

CROSS-REFERENCE TO RELATED APPLICATION

The present application is a 371 of International Application No. PCT/US2012/050145 which was published in English on Feb. 14, 2013, and claims the benefit of U.S. Provisional Application No. 61/522,547 filed Aug. 11, 2011, both of which are incorporated herein by reference in their entireties.

FIELD

The present invention relates to an apparatus and method for drying liquid coatings on a substrate. More particularly, the invention is directed to an inerted plate dryer and its use in drying solvent based coatings.

BACKGROUND

Drying or curing of liquid coatings on a substrate or web is typically achieved by passing the substrate through a drying chamber, in most cases, a conventional oven (either a floatation or roller supported oven), where the liquid is evaporated and the coating is dried or cured. The oven is heated with heating elements. The heat is passed onto the coating through convection or forced gas flow, typically air. Multiple zones of the oven may be employed to allow flexibility in the temperature adjustment. When organic solvent is used in the coating where explosion and fire can be a potential hazard, regulations impose a maximum concentration of the solvent allowable in the drying chamber to ensure safety of operation. This maximum concentration is defined in terms of a fraction or most often as a percentage (% LEL) of the lower explosive limit (LEL) of the solvent or mixture of solvents removed from the coating undergoing drying or curing. LEL is the lowest concentration where a conflagration or explosion can be propagated from an initially ignited point; LEL is a property of the solvent or solvent mixture, whereas % LEL is just a measure of concentration of a particular solvent or solvent mixture referred to the LEL of that solvent or solvent mixture. The maximum allowed solvent concentration in a given dryer (in terms of % LEL) that a dryer is allowed to safely handle by regulation ultimately does limit substrate or web speed.

The solvent removed from the coating is either condensed into liquid form through a condensation system, or more commonly burned by a thermal oxidation unit (TOX). When a condensation system is used, it often includes a tandem of condensers, typically and needs to operate at a low temperature (below 0° C.) to condensate most of the solvent, with a correspondingly high demand on energy. When a TOX unit is used, there is a maximum amount of solvent per unit time that can go through a TOX due to safety (explosivity, which constrains solvent concentration, and energy release, i.e. maximum operating temperature, which constrains the throughput). This imposes a limit on the solvent content out of the combined streams sent to the TOXs, and therefore ultimately imposes a limit on the maximum substrate speed through the oven.

To make a conventional oven inert, i.e. to use inert gas, rather than the oxygen rich air, could alleviate the potential of explosion and fire, and therefore, increase the solvent throughput a dryer can handle. However, the volumes and flow rates of the inert gas involved in that operation can make it expensive and affect adversely the economic viability of the process.

Another typical issue associated with conventional oven is blistering, i.e., appearance of bubbles in the dried coating. It is caused by rapid bubble growth from gases dissolved or entrained in the coating liquid and from the volatile solvents in the coating, which exhibit a high vapor pressure. To alleviate blistering or to allow the healing of blistering, usually both temperature and speed of the gas (commonly air) is reduced, typically in the first zone(s) of the oven when multiple zone are used.

Another approach to increase the throughput of a conventional oven is to add additional heating zones to that oven. However, the size and volume of conventional ovens makes it difficult to add new zones to retrofit existing installations. Accidents involving explosion or conflagration of solvent laden air above LEL concentration would also involve a greater volume of explosive mixture; Inertization becomes more expensive with the additional zones to inert and may take considerable time (15 to 30 or more minutes). This creates further delays in case of web rupture, which need dryer opening, cleaning, rethreading of the web, and re-inertization.

Another type of dryer that can be used for drying liquid coatings is a plate dryer. They may include heated plates at one or both sides of a moving web. They have been used in pultrusion and other curing processes. In these applications process velocities are low (<30 m/min). Typical flows of the inerted gas-solvent mix are in the range of 1 m/s with low external mass transfer and heat transfer, which makes it not suitable for higher speed coating lines.

U.S. Pat. No. 4,894,927, assigned to Fuji Photo, teaches the benefits of a low volume inerted plate dryer and how the system can include solvent recovery by condensation and how heat can be recovered by placing a heat exchanger between the dryer and the condenser. Furthermore, U.S. Pat. No. 4,926,567, also assigned to Fuji Photo, teaches how the incoming inert stream can be heated by heat exchange with the exhaust of an incinerator where the recovered solvent is burned. Neither patent teaches how the systems are sealed to avoid contamination of the ambient air to the heater and vice versa. Nor do they teach what conditions are needed for the system to be beneficial. Furthermore, both patents consider that the entire dryer exhaust stream undergoes condensation.

One type of plate dryers is designed with internal condensing surfaces, which are sometimes referred to as "gap dryers". In this type of dryer heat is provided by a hot plate or any other suitable source. The carrier web moves over the plate or close by. Condensation occurs inside the dryer, over a cold surface that creates a concentration gradient that drives significant diffusion of the solvent. U.S. Pat. No. 5,581,905 (and sequels) assigned to 3M teaches substantially horizontal configurations of the plates where the cold surface is kept as close as ~0.5 cm above the drying wet coating. Condensation occurs on the lower surface of the cold top plate which is grooved such that capillarity drives the liquid out towards the edges where it is drained. No significant convective gas flow occurs inside the dryer apart from that induced by web drag. There is the possibility of solvent dripping over the drying coating, as well as water condensation if air enters the system.

Therefore, there is a need for a dryer that can dry solvent based coating with high efficiency, high throughput and more economical than existing dryers.

BRIEF SUMMARY OF THE INVENTION

The embodiments of the present invention described below are not intended to be exhaustive or to limit the invention to the precise forms disclosed in the following detailed description. Rather, the embodiments are chosen and described so that others skilled in the art may appreciate and understand the principles and practices of the present invention.

The present invention is directed to an inerted plate dryer and the method of using it to dry organic solvents-based coatings.

In one embodiment of the invention, an apparatus for drying a continuous moving web carrying a liquid layer, comprises: a housing enclosing a drying chamber, said housing having entry and exit slots through which said web may be passing through said chamber; said entry and exit slots having a sealing mechanism to prevent leakage of ambient air into the drying chamber, or leaking out of the gas stream from the chamber into the ambient; a bottom heated plate and a top heated plate aligned substantially parallel to each other with a space between them, said space is no more than 10 cm distance apart and preferably less than 5 cm apart, and most preferably between 0.5 to 5 cm apart; at least one inlet for a gas stream to flow into the chamber with a velocity, said velocity is between 2 m/s and 20 m/s, and preferably 6-15 m/s, flowing mainly in either the direction of the substrate movement, i.e. co-current, or against the direction of the substrate movement, i.e. countercurrent; at least one outlet for an exhaust to flow out of the chamber, wherein the carrier web is closer to the bottom plate than to the top plate.

In another embodiment of the invention, a method of drying a continuously moving web carrying a liquid, comprises passing the web through an enclosed dryer via entry and exit slots communicating wherewith; heating the web from both top and bottom using a top and a bottom heated plates, with said web located closer to the bottom heated plates; passing a gas stream from at least one inlet and flowing over the web at a velocity at least 2 m/s to generate an exhaust; discharging the exhaust through at least one outlet; dividing the exhaust into a condensing stream and a by-pass recycled stream; passing the condensing stream through a condenser to generate a liquid condensate and a solvent stripped stream; and mixing the recycled stream with the stripped stream and a make-up inert gas stream to form a inlet gas stream.

In another embodiment of the invention, a method of drying a continuously moving web carrying a liquid, comprises passing the web through an enclosed dryer via entry and exit slots communicating wherewith; heating the web from both top and bottom using a top and a bottom heated plates, with said web located closer to the bottom heated plates; passing a gas stream from inlets located close to each one of the entry and exit slots and flowing over the web, towards the middle of the dryer in co- and counter-current streams, at a velocity at least 2 m/s to generate an exhaust; discharging the exhaust through one outlet situated at the middle of the dryer; passing the condensing stream through a condenser to generate a liquid condensate and a solvent stripped stream; and mixing the recycled stream with the stripped stream and a make-up inert gas stream to form a inlet gas stream.

In yet another embodiment of the invention, a method of drying a continuously moving web carrying a liquid, comprises passing the web through an enclosed dryer via entry and exit slots communicating wherewith; heating the web from both top and bottom using a top and a bottom heated plates, with said web located closer to the bottom heated plates; passing a gas stream from a inlet located close to the middle of the dryer, splitting into co- and countercurrent streams, and flowing over the web, towards each dryer extreme, at least 2 m/s to generate exhausts; discharging the exhausts through outlets situated close to each one of the entry and exit slots; dividing the exhausts into a condensing streams and a by-pass recycled streams; passing the condensing streams through a condenser or condensers to create condensate stream(s) and solvent stripped stream(s); and mixing the recycled streams with the stripped streams and a make-up inert gas stream to form a inlet gas stream.

In yet another embodiment of the invention, a method of drying a continuously moving web carrying a liquid, comprises passing the web through an enclosed dryer via entry and exit slots communicating wherewith; heating the web from both top and bottom using bottom heated plates and at least one special unit atop, with said web located closer to the bottom heated plates; the special units atop can be but are not limited to IR lamps, UV lamps, electron beam emitters, radio frequency emitters, ultrasound sources, etc. which can be used alone, or in combinations between them and also with heated plates; passing a gas stream from at least one inlet, and flowing over the web at a least 2 m/s to generate a exhausts; discharging the exhausts through outlets situated close to each one of the entry and exit slots; dividing the exhausts into a condensing streams and a by-pass recycled streams; passing the condensing streams through a condensation system to create condensate stream(s) and solvent stripped stream(s); and mixing the recycled streams with the stripped streams and a make-up inert gas stream to form a inlet gas stream.

Other features and advantages of the present invention will become apparent to those skilled in the art from the following detailed description. It is to be understood, however, that the detailed description of the various embodiments and specific examples, while indicating preferred and other embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

These, as well as other objects and advantages of this subject matter, will be more completely understood and appreciated by referring to the following more detailed description of the presently preferred exemplary embodiments of the subject matter in conjunction with the accompanying drawings, of which.

DETAILED DISCUSSION OF THE INVENTION

Figure 1:
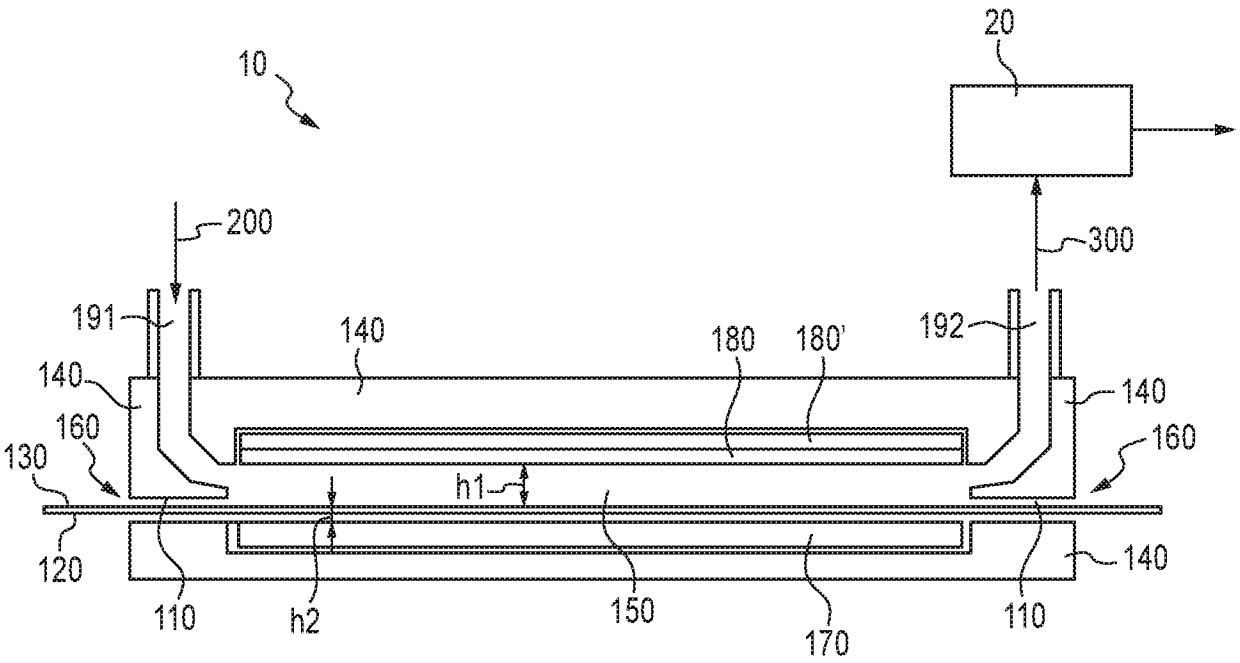
FIG. 1 is a schematic drawing of an exemplary embodiment of the invention.

Referring to FIG. 1, an embodiment of the invented inerted plate dryer 10 comprises a housing 140, a drying chamber 150 enclosed by the housing, an entry slot and an exit slot 160 where a moving web 120 with a liquid coating layer 130 will be passing through the chamber through the entry and exit slots. A top heated plate 180 and a bottom heated plate 170 substantially parallel to each other inside the drying chamber. At least one inlet 191 and at least one outlet 192 are located on the housing. The present invention contemplates that the at least one inlet 191 comprises a nozzle and the nozzle is pointed towards the direction of the at least one outlet 192. Gas stream 200 flows into the drying chamber through the inlets and the solvent laden exhaust 300 flows out of the chamber through the outlets. The distance between the moving web 120 and the top heated plate 180 is h1. The distance between the moving web 120 and the bottom heated plate 170 plate is h2. Entrance and exit seals 110 serve to minimize both the entrainment or convection of ambient air into and the solvent laden exhaust out of the oven. A seal may include inerted gas streams issued from either or both faces of the seal, to improve containment. A fraction of the solvent laden stream 300 that may circulate between the heated plates of the present invention may be fed to an exit seal. The present invention contemplates that in one embodiment the gas that is fed through the exit seal may be captured by a draft of an upstream conventional dryer having an entrance that is kept at sub-atmospheric pressure, via a suitable connecting tunnel. Downstream to the inerted plate dryer, a condensing system 20 can be used to condense the solvent out of the exhaust. The solvent stripped stream can then go through a fan and heat exchanger or recuperator before it is sent back as the inlet gas stream. A make-up amount of inert gas may be added to the inlet stream. This make-up stream may be a fraction of the inert gas fed to the seals at the dryer extremes.

Throughout this disclosure, the term top heated plate refers to the heated plate that faces the liquid coated side of the web or substrate. The term bottom heated plate refers to the heated plate that faces the other side of the web or substrate.

The oven can be made inert by saturating it with a proper inert gas, and by maintaining an Oxygen concentration under a critical value, typically at approximately 8% by volume or below. Table 1 lists the maximum oxygen concentration in percentage of volume below which explosion or deflagration or the gaseous mixture containing a solvent can't occur. During operation of the inerted dryer, fresh inert gas would be provided at the entrance seal and additionally in the recirculation system if needed. The system must be equipped with an appropriate number of O2 sensors so to effectively monitor the O2 concentration within the oven chamber and the recirculation ducts. The 90% response time of the monitoring system should be preferably less than 20 s, meaning that the system will signal 90% of the magnitude of a change in concentration within 20 s from its occurrence. The system can be set to alarm at a much lower level, such as 3% of oxygen by volume, and trigger a coater shut-down at 4% oxygen by volume.

The inert gas can be any appropriate gas, such as nitrogen or CO2. Due to low or no oxygen concentration, the risk of explosion and fire is greatly relieved and therefore, the restriction on the amount of solvent in the gas stream is no longer relevant. This leads to one advantage of the inerted plate dryer where higher percentage of solvent can exist in the gas stream inside the drying chamber. Therefore a significant portion of the solvent in the exhaust stream can be recycled back into the dryer. The demand on the downstream condenser is greatly relieved as lesser amount of solvents need to be condensed.

The existence of higher amount of solvent vapor in the gas stream has another benefit: it relieves blistering and delivers defect free coating. The maximum amount of solvent vapor that can be used in the gas stream depends on the type of solvent. The presence of the most volatile solvents in significant concentrations but quite below the saturation concentration, will alleviate blistering by inhibiting the evaporation of the most volatile solvents without a drastic reduction of drying capacity. On the other hand if some of these most volatile solvents are good solvents, they will plastify the upper layer of the coating being dried, avoiding or delaying transfer skinning (formation of a dense layer that exhibits strong resistance to solvent transfer), and therefore will alleviate the blistering consisting of bubbles trapped by the skin layer. In general, as long as the concentration of that solvent in the gas stream is a fraction (for example less than 60%) of the equilibrium concentration, significant mass transfer can still be achieved inside the dryer. For approximate estimation purpose, this would mean that the partial pressure of the solvent in the gas stream over the drying coating is less than the vapor pressure of the solvent at the gas stream temperature times the mol fraction of the solvent in the coating just below the gas stream.

The inerted plate dryer can be also be beneficial when operated as a deaerator. When there is a significant amount of gas dissolved or entrained in the liquid coating, operating the inerted plate dryer with the inerted gas stream saturated or close to saturation with solvent will inhibit solvent evaporation, while heating the liquid coating will facilitate the escape of the dissolved or entrained gas. These conditions are also the better suited for the liquid coating to heal if there were bubble bursting.

Figure 2:
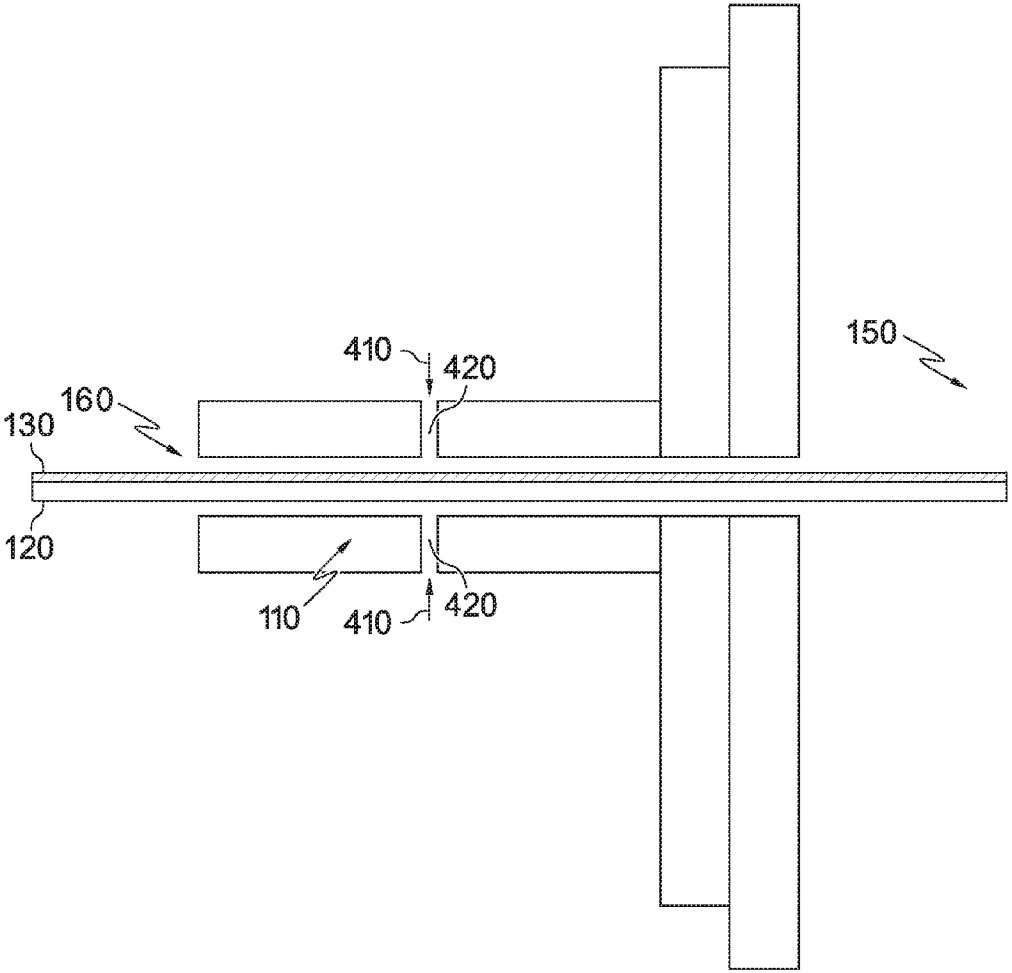
FIG. 2 is a schematic drawing of a seal (sluice) for an exemplary embodiment of the invention.

To ensure inerted environment inside the heating chamber, the entry and exit slots 160 need to be properly sealed. One embodiment of the invention uses seals with top and bottom faces close enough to the coated substrate to minimize entrainment or convection of ambient air into that oven and the escape of solvent laden gas out of the oven. Referring to FIG. 2, a substrate 120 coated with a liquid layer 130 enters or exits the seal mechanism (or sluice) 110 through the slot 160. The slot 160 may be a narrow passage specifically for the substrate. Either one or both of top and bottom parts of the seal can be made movable perpendicularly to the coated substrate. These seals operate at a minimum distance from the web in the magnitude of a few mm, uniformly across the dryer width. A control mechanism can be set up so that the top seals at the entrance and exit can open up, preferably to 15 to 30 mm to allow for the passage of splice or any other gross defect that would interfere with the entrance or exit clearance. This control mechanism can include a signal that is provided both by the liner unwinder splice actuator, and by events in the coating head, for example, a reverse roll back-up roll nip opening, or the withdrawal of a coating die. The seals are preferred to open at an appropriate delayed time. Also, it is desirable to be able to manually give a signal for the seal opening at any time. The opening of the seals must be appropriately coordinated with the gas flow control of the oven, so not to loose inertization of the oven over a short (less than 10 s) open time. When in position, the seals will be fixed, e.g. via springs/pressure, so that they can be pushed open by an unforeseen interference due to an obstruction carried by the web, or an undetected splice. This will avoid severe damage to the seals.

In addition to narrow opening, other methods can also be used to prevent leakage at the entrance or exit slots, such as impinging jets, inerted gas curtains, labyrinths, conditioning chambers, gas extraction slits, etc. For example, still referring to FIG. 2, in addition to the small clearance slot 160 one or more inerted gas streams 410 are fed through narrow slits 420 to create an impinging jet; the slits can be angled for improved containment and isolation of the drying chamber 150 from the exterior environment. To further refine the example, the slits 420 could deliver a couple of N2 planar jets (one from the top and one from the bottom of the web) which will uniformly cover the entire width of the web. The oven exit seals would also have similar jets. These exit seal jets can be fed at a desired flow rate to preclude entrance of O2 to the oven.

If the inerted plate dryer is installed ahead of a conventional oven which entrance is at a slightly below atmospheric pressure then the exit seal may use process N2 from the inerted dryer recirculation loop (polluted with organic solvents vapor) provided that the solvent laden gas issued by the exit seal is delivered to the entrance of the conventional oven through a connecting enclosure.

The gas stream can be fed into the heating chamber in concurrent or counter-current directions with respect to the moving coated substrate. In the co-current feeding, the gas stream comes in through inlets near the substrate entrance, and the exhaust is discharged through the outlets near the substrate exit. In the countercurrent feeding, the gas stream comes in through inlets near the exit, and is discharged through the outlets near the entrance. An initial co-current followed by counter current feeding can be achieved through feeding through inlets near both entrance and exit slots, and discharging through an outlet in the middle of the chamber. Similarly, an initial counter-current followed by co-current feeding can be achieved through feeding through an inlet at the middle of the dryer and discharging through outlets near both entrance and exit slots. Also, a single inerted plate dryer can include a multiplicity of co-current and countercurrent sections, with the adequate placement of inlets and exhausts for the gas stream. The direction of feeding does impact the interaction between the hot inerted gas stream and the coated liquid layer and therefore the drying history of the coated layer and, in consequence, the efficiency of drying.

Figure 4:
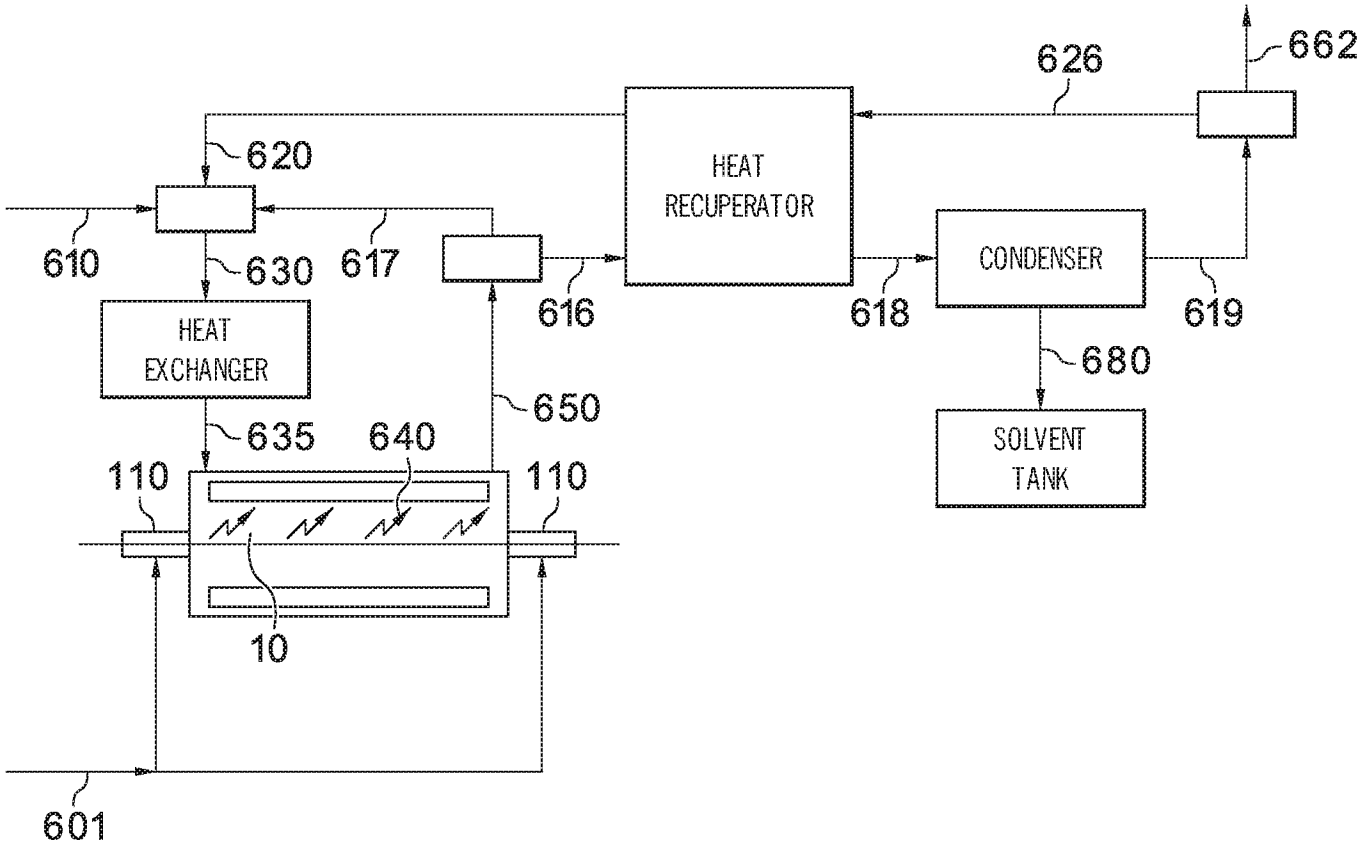
FIG. 4 is a schematic of the gas flow.
Figure 5:
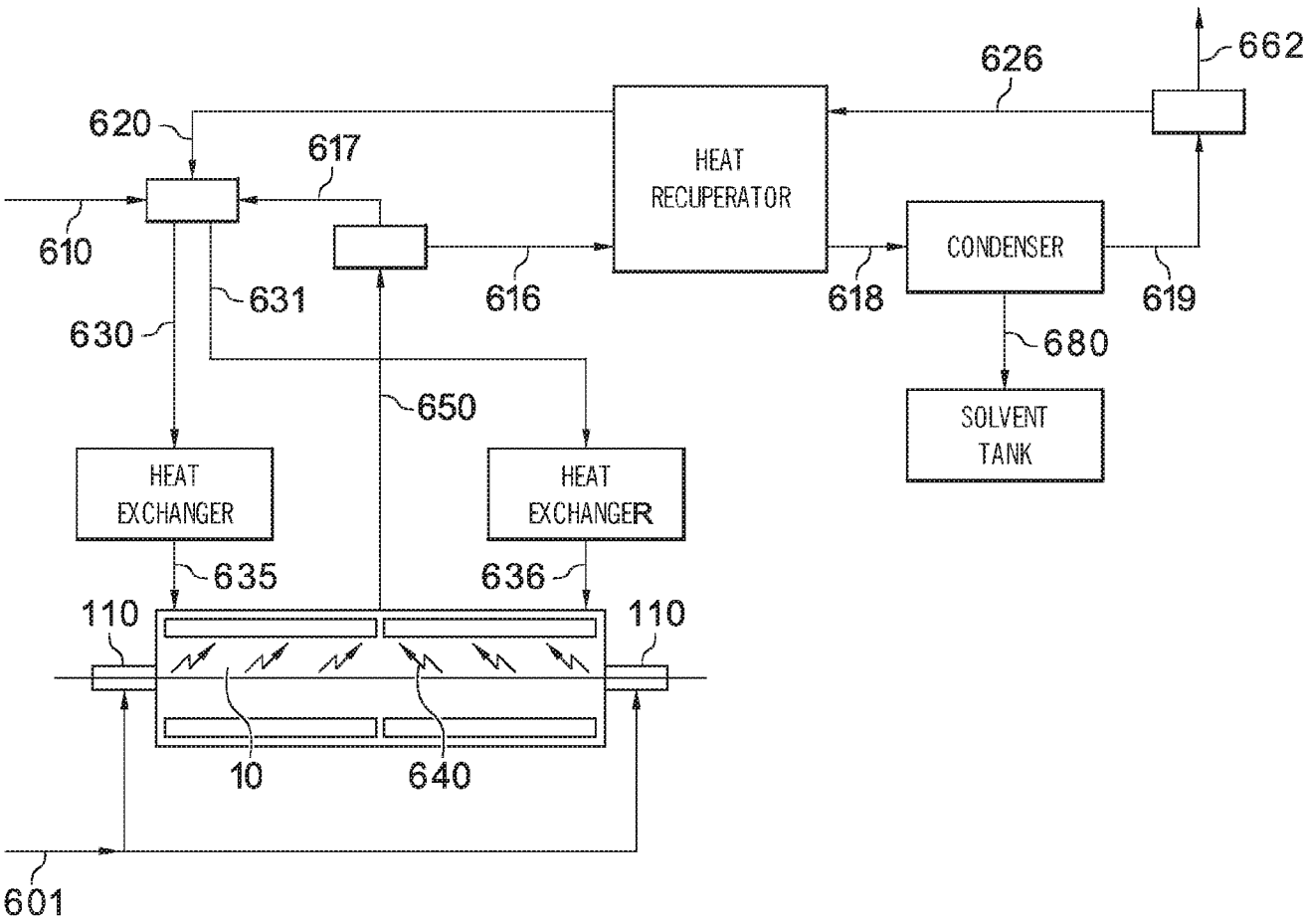
FIG. 5 is a schematic of the gas flow in an alternative configuration.
Figure 6:
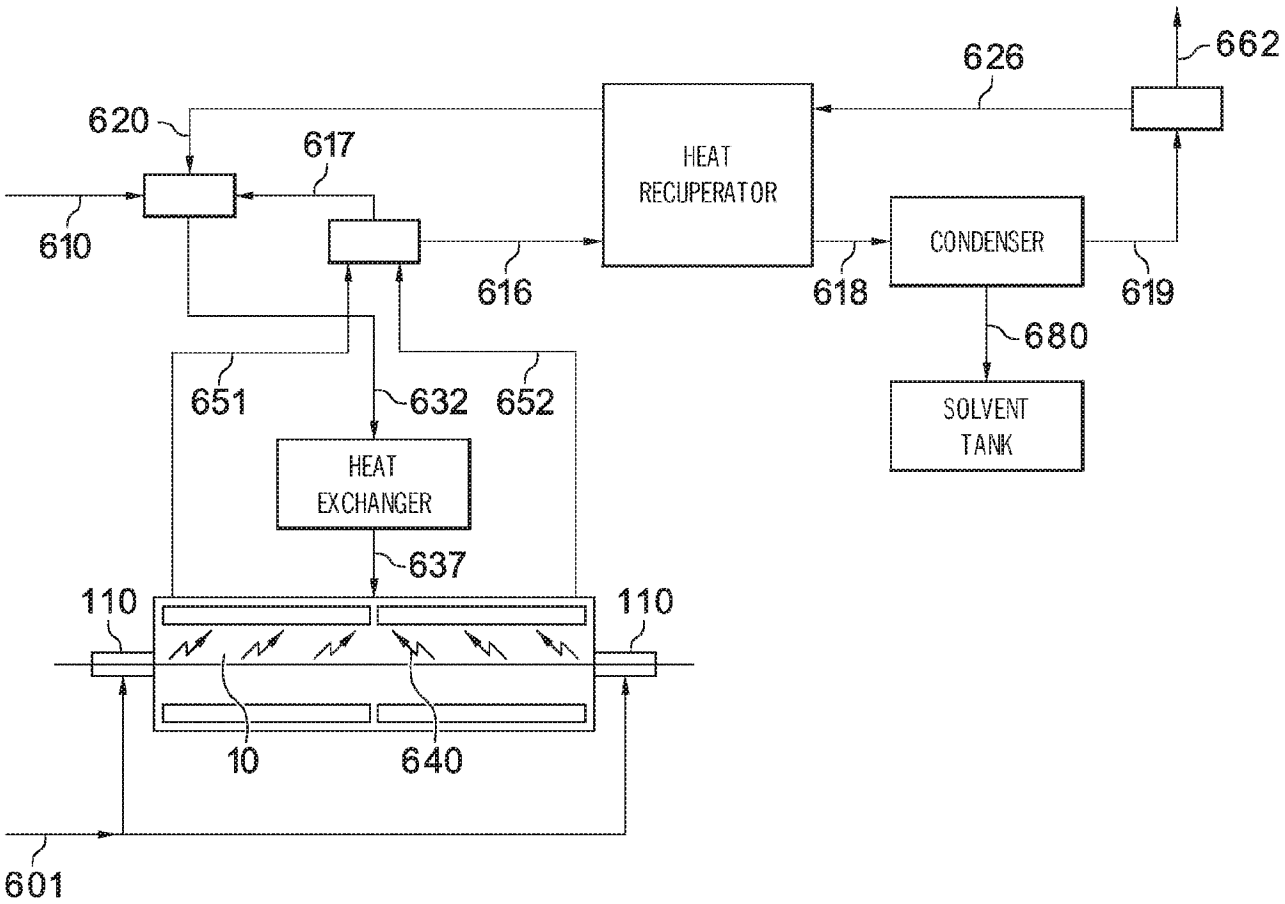
FIG. 6 is a schematic of the gas flow in an alternative configuration. Unless otherwise indicated, the illustrations in the above figures are not necessarily drawn to scale.

Now referring to FIG. 4 which is a schematic drawing of how gas flowing in and out of the inerted plate dryer. Fresh inert gas 601 is fed to the seals 110 to improve containment. Part of these inert streams enters the inerted oven and part is released to the atmosphere. If so required as make-up a fresh inert gas 610 is mixed with a certain amount of by-passed exhaust 617 and solvent stripped stream 620 to make the stream 630, which can be conditioned by a heat exchanger to make the feed 635. After going through the heating chamber 10 and collecting solvent vapor 640 from the coating, the exhaust 650 is split into two streams 616 to be condensed and 617 as the bypass. Stream 616 cools down, through a heat recuperator, to stream 618 that passes through a condenser to have to solvent 680 collected into a solvent tank. The rest of the stream 616, including the inerted gas and the un-condensed solvent makes up stream 619 which is then split into a small stream 662 to be purged to TOX and the stream 626 which then goes through a heat recuperator to give the warmed solvent stripped stream 620 which is mixed with the by-passed exhaust and fresh inert gas to become the stream 630 which after heating up becomes the feed 635, as described in the beginning of this section. When the gas flows through the drying chamber at a high gas velocity, pressure drop through the drying chamber can be significant. For example, if the pressure inside the drying chamber near one seal is adjusted to be close to atmospheric, then the pressure inside the drying chamber near the other seal can depart significantly from atmospheric. This significant drop in pressure may deteriorate seal performance, for example by inducing so large a flow that it sweeps the impinging jets inside the seal: this situation can be solved by introducing the gas feed at locations near the entry and exit seals while exhausting through a slot near the middle of the dryer (or alternatively feeding near the middle of the dryer and exhausting through ports close to the entrance and exit seals). Now referring to FIG. 5 which is a schematic drawing of how gas flowing in and out of an alternative configuration of the inerted plate dryer. Fresh inert gas 601 is fed to the seals 110 to improve containment. Part of these inert streams enters the inerted oven. If so required as make-up, a fresh inert gas 610 is mixed with a certain amount of by-passed exhaust 617 and solvent stripped stream 620 to make the streams 630 and 631, which can be conditioned by heat exchanger(s) to make the feeds 635 and 636. After going through the heating chamber 10 and collecting solvent vapor 640 from the coating, the exhaust 650 is split into two streams 616 to be condensed and 617 as the bypass. Stream 616 cools down, through a heat recuperator, to stream 618 that passes through a condenser to have to solvent 680 collected into a solvent tank. The rest of the stream 616, including the inerted gas and the un-condensed solvent makes up stream 619 which is then split into a small stream 662 to be purged to TOX and the stream 626 which then goes through a heat recuperator to give the warmed solvent stripped stream 620 which is mixed with the by-passed exhaust and fresh inert gas to become the streams 630 and 631 which after heating up become the feeds 635 and 636, as described earlier in this section. FIG. 6 shows two outlets situated close to the entry slot and the exit slot of the housing and the inlet is situated at the middle of the chamber. FIG. 6 shows warmed solvent stripped stream 620 is mixed with the by-passed exhaust and fresh inert gas to become stream 632, which after heating becomes the feed 637. After going through the heating chamber 10 and collecting solvent vapor 640 from the coating, the exhausts 651 and 652 are combined and then split into two streams 616 to be condensed and 617 as the bypass.

It should be stressed that a single inerted plate dryer unit can comprise one or more co-current and countercurrent inerted gas stream section, with the placement of multiple feed and exhaust ports for the inerted gas stream.

The top heated plate and the bottom heated plate can be heated through any suitable mechanisms known by person skilled in the art. The plates can be single units or arrays of smaller plates, as may be required to accommodate a curved path, and also to allow flexible temperature control. Each heated plate or plate array can have one or multiple heating zones. The temperature of each zone can be adjusted independently, so that, for example, temperatures of plates atop the web can be different from that of the plate under the web, or one of these plates can be heated and the other set at ambient temperature. The temperature can also vary from one zone to another for the same plate or plate array along the web path. Also, top plates may be substituted totally or partially or be intercalated by special units such as IR lamps, UV lamps, electron beam emitters, radio frequency emitters, and ultrasound sources (shown as item 180' in FIG. 1). The gap h between the two plates is kept at a small number to ensure efficient heat transfer, and high enough gas velocity inside the chamber. Such inter-plate gap is preferred to be no more than 10 cm apart. It is even more preferred to be less than 5 cm apart and it is most preferable when it is between 0.5 and 3.5 cm. The plate spacing near the extremes can be larger than in the rest of the dryer to accommodate the feed and exhaust assemblies as well as the mounting of the seals. The moving web is positioned in between the two heated plates, being closer to one of the plates, preferably the bottom plate. The distance h2 between the bottom heated plate and the moving web should be kept as small as possible. It is preferred to be less than a 20 mm. It is even more preferred to be less than 10 mm. The distance h1 between the top heated plate and the moving web should also be kept to be no greater than a few cm. It is preferred to be less than 5 cm. The plates can have a mechanism that allows adjustment of the distance between the corresponding top and bottom plates. The distance from the bottom plate to the web, which can move over rollers, can be set by adjusting the bottom plate.

The top and bottom heated plates may be angled with respect to each other. The angle between the top and bottom plates can vary along the path of the web for best drying effect or accommodating other accessories. These sections where the top plates and the bottom plates are at an angle to each other may be used to control the pressure along the inerted gas stream path as kinetic and pressure energy are exchanged, with certain losses, in the converging & diverging passages that the plates create. Thus adequate placement these of converging and diverging zones near the inlet and exit seals for pressure regulation may facilitate seal action. Also, greater velocity in the narrower sections would enhance heat transfer and the associated mass transfer.

The surface of each heated plate can be smooth, or textured. Textures can be designed to enhance mixing (likely turbulent atop the substrate and laminar between the substrate and the bottom plate) to enhance mass and heat transfer rates inside the chamber. The textures on the bottom plate can also be designed to create a laminar layer between the bottom plate and the web such that the web can move as close as possible to the heated plate without actually touching the plate. Eddies in cavities on the lower plate can also be used to increase or maintain high enough heat transfer rates. The simplest texturing is shallow slots running across the plates' width. Also, localized depressions can be produced on the plate surface, in a staggered pattern with respect to the direction of flow of the inerted gas stream (or machine direction). Alternatively, fixtures can be mounted over the plates, as thin strips running across the plates' width. Also other shapes such as but not limited to thin discs, ovals or tear shaped flats could be mounted in a staggered pattern, in the machine direction, to enhance secondary flows. If these fixtures are made of soft material, they can be used to support the substrate, which would slide over the fixtures, instead or in addition to rollers In another embodiment of the invention, multiple inerted plate dryers can be used along the web moving direction. This can be effective when just one inerted plate dryer would not be able to dry the coating satisfactorily, even with optimized operating conditions. The design length of a single inerted dryer zone is ultimately limited by pressure drop through the drying chamber, which may reduce the effectiveness of the seal. Also when an oven length is too long high solvent concentration can accumulate in the gas stream, which would deteriorate mass transfer on the remaining length of the oven and make the oven ineffective.

Figure 3:
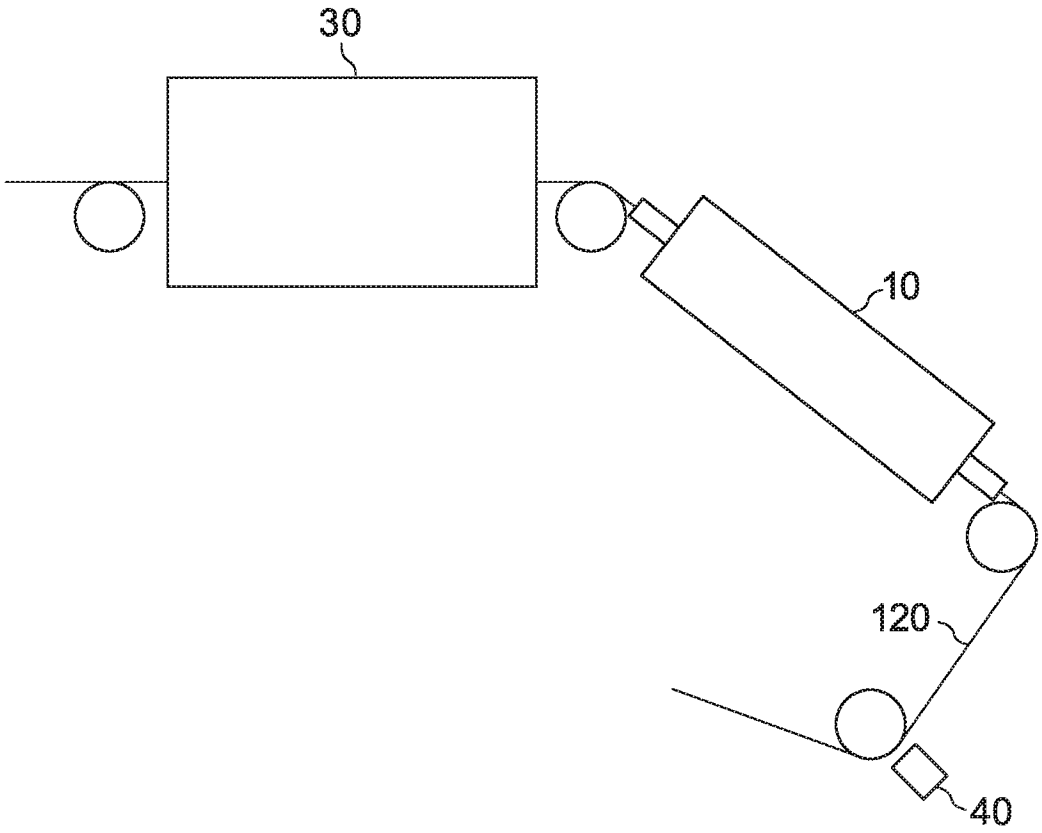
FIG. 3 is a schematic drawing of an exemplary embodiment of the invention.

The inerted plate dryer of the current invention can be used as a stand-alone drying unit, or as an add-on to an existing installation, due to its smaller volume and slender size. For example, it can be positioned before a conventional oven. The inerted plate dryer can be used to flash out a significant amount of solvent from the initially solvent-rich coating to deliver a partially dried coating to the conventional oven, and therefore relieve the amount of solvent to be handled by the downstream conventional oven and the installed TOX. Therefore, the use of the inerted plate dryer as a first drying zone can increase overall drying efficiency for a given total length of oven. This can be advantageous when used to increase capacity of older assets. FIG. 3 illustrate such an exemplary usage of the inerted plate dryer. The inerted plate dryer 10 is placed after the coating station 40, in the fly-up of the substrate 120 to a conventional oven. When using the inerted plate dryer in this arrangement, care should be taken in setting the operation parameters so that the inerted plate dryer does not cause the coating to be overheated and therefore lead to severe blistering there, and/or exceed the LEL limit in the conventional oven 30 downstream.

Given targets of line speed and final residual solvent concentration, there is a minimum length of the inerted plate dryer needed to deliver a defect free dried coating. If the inerted plate dryer is shorter that this minimum length, it is not beneficial because either a) the dried coating at the end of the dryers retains a high solvent concentration, at low temperatures of the inerted gas stream and heated plates, and/or b) blistering is induced inside the inerted plate dryer and/or solvent concentration is exceeded in the following conventional dryer as the temperatures of the inerted gas stream and/or heated plate are increased. Even though an IPD is well suited as a first drying zone preceding a conventional dryer, the drying efficiency, as measured by the maximum speed at which a given coating can be dried, can reach a maximum as the ratio of inerted plate dryer length to overall oven length is increased; this would happen when the conventional dryers exhibits better heat and mass transfer efficiencies, as modern high speed floatation ovens are bound to have, despite their LEL limitation, which in any case becomes irrelevant at the latter stages of drying. Therefore, there is an optimal window for design and operation of an inerted plate dryer.

Table 2 is an example of operating parameters to demonstrate the concept of a minimum length of the plates. The inerted plate dryer is placed before a conventional oven with multiple zones. The amount of solvent in the coating upon entering zone 1 of the conventional oven is calculated as a percentage to the lower explosivity limit (LEL) allowed at the operating condition in the ensuing conventional zone 1. Starting from a case with marginal % LEL (45% LEL) in that zone and keeping the plates at 2.2 m long, increasing or decreasing the temperature of the plates and of the inert gas does not decrease the amount of solvent in the gas of the ensuing conventional zone 1. Therefore the inerted dryer cannot be beneficial for line speed increase. When the plate length is increased to 3.2 m, and the gas and plate temperatures to 120 C the amount of solvent in the coating entering zone 1 is significantly lower than that without the inert plate dryer. Therefore the line speed can be increased until the LEL in the conventional zone reaches the limit of 45% LEL again. The inerted plate dryer is now beneficial.

In operating the inerted plate dryer, finding the window for design and operation require the optimization of the design and operation parameters, such as plate number, plate lengths, plate temperature, gas velocities, fraction of the gas stream that undergoes condensation, condenser conditions, etc. In general, optimal design and operating conditions are dependent on the solvent compositions of the coating. Both the design and operation optimization entail the analysis of the mass, energy and momentum balances for each drying zone, together with size and operational constrains. Given the size and complexity of this analysis and optimization, full analysis requires the use of modern numerical process simulation, as is obvious to a knowledgeable practitioner of the art.

In the processes described above, other ancillary equipments, such as fans, de-misting equipment, water separators, valves (controlled or not), etc., can be also used, as is evident to a knowledgeable practitioner of the art.

The foregoing detailed description of the present invention is provided for purposes of illustration, and it is not intended to be exhaustive or to limit the invention to the particular embodiments disclosed. The embodiments may provide different capabilities and benefits, depending on the configuration used to implement the key features of the invention. Accordingly, the scope of the invention is defined by the following claims.

TABLE 1

Maximum Oxygen Concentration (MOC) of Selected Solvents. Below the MOC explosions and conflagrations cannot propagate.

| Temperature | IPA | Ethly Acetate | Hexane | Toluene |
|---|---|---|---|---|
| 20 | 8.7 | 9.8 | 9.3 | 9.5 |
| 100 | 8.1 | 9.1 | 8.9 | NA |

TABLE 2

Exemplary case: drying of a 1.5 m wide, 24 g/sq.m solvent based coating with 24.5% solid content, with the solvent containing 60% toluene, 6.5% hexane, 25.7% ethyl acetate and 8.1% n-propanol.

| IPD total plates length (m) | Plate and inerted (N2 + solvent) gas stream temperature (° C.) | Inerted Gas Velocity (m/s) | Web speed (m/min) | Solvent concentration at in the first zone of the downstream conventional oven (% LEL) |
|---|---|---|---|---|
| 0 (no inerted dryer) | — | — | 70 | 45 |
| 2.2 | 80 | 4 | 70 | 46 |
| 2.2 | 140 | 4 | 70 | 48 |
| 3.2 | 140 | 4 | 70 | 42 |
| 2.2 | 160 | 4 | 70 | 51 |

All patents, published applications, and articles noted herein are hereby incorporated by reference in their entirety.

While the subject matter has been described in connection with what is presently considered to be the most practical and preferred embodiments, it will be apparent to those of ordinary skill in the art that the subject matter is not to be limited to the disclosed embodiments, and that many modifications and equivalent arrangements may be made thereof within the scope of the subject matter, which scope is to be accorded the broadest interpretation of the appended claims so as to encompass all equivalent structures and products. It is particularly contemplated that one or more features or aspects of any one or more embodiments described herein, can be combined with one or more other features or aspects of other embodiments.

What is claimed is:

1. An apparatus for drying, curing, or deaerating a continuous moving web carrying a liquid layer, comprising:

a housing enclosing a drying chamber, said housing having entry and exit slots through which said web may be passing through said chamber; said entry and exit slots having a sealing mechanism to prevent leakage of ambient air into the drying chamber, or leaking out of the gas stream from the chamber into the ambient;

a bottom heated plate and a top heated plate aligned substantially parallel to each other with a space between them, said space is no more than 10 cm distance apart;

the web that carries a liquid layer is located less than 20 mm from the bottom heated plate;

at least one inlet for a gas stream to flow into the chamber with a velocity, said velocity is between 2 m/s and 20 m/s;

at least one outlet for an exhaust to flow out of the chamber, wherein the carrier web is closer to the bottom plate than to the top plate;

wherein the apparatus is used as first drying zone, ahead of a conventional oven;

wherein a fraction of a solvent laden stream that circulates between the heated plates of the apparatus is fed to the exit seal as impinging seal(s);

where the gas released by the exit seal is captured by a draft of an upstream conventional dryer which entrance is kept at sub-atmospheric pressure.

* * * * *